United States Patent [19]

Dobbin

[11] Patent Number: 4,584,783

[45] **Date of Patent: * Apr. 29, 1986**

[54] SHOE TONGUE HOLDER ASSEMBLY

[75] Inventor: Thomas M. Dobbin, Denver, Colo.

[73] Assignee: Kaepa, Inc., San Antonio, Tex.

[ * ] Notice: The portion of the term of this patent subsequent to Apr. 17, 2001 has been disclaimed.

[21] Appl. No.: 600,352

[22] Filed: Apr. 16, 1984

Related U.S. Application Data

[63] Continuation of Ser. No. 376,425, May 10, 1982, Pat. No. 4,442,613.

[51] Int. Cl.[4] ..... A43B 11/00; A43B 23/26

[52] U.S. Cl. ..... 36/50; 36/54

[58] Field of Search ..... 36/50, 51, 54, 114, 36/129, 102

[56] References Cited

U.S. PATENT DOCUMENTS 3,546,796 12/1970 Adams ..... 36/102
4,377,913 3/1983 Stone ..... 36/54 X

FOREIGN PATENT DOCUMENTS 2438554 2/1975 Fed. Rep. of Germany ..... 36/114
2390120 12/1978 France ..... 36/50

OTHER PUBLICATIONS

*Velcro Product News,* May 1978, PN No. 45, Velcro USA, Inc., New York, N.Y. 10022.

*Primary Examiner*—James Kee Chi
*Attorney, Agent, or Firm*—Cohn, Powell & Hind

[57] ABSTRACT

The shoe tongue holder assembly includes a vamp including oppositely disposed upper portions overlying a tongue, and a securing assembly for interconnecting the upper portions of the vamp for selectively adjusting the fit of the upper portions of the vamp over and on the tongue and adjusting the fit of the vamp for the comfort of the wearer. A hook and loop fastener operatively interconnects the tongue and vamp for holding the tongue in place while placing the shoe on the foot and while wearing the shoe. The hook and loop fastener includes a hook portion and a loop portion, one of the hook and loop portions being fixed to the tongue and the other of the hook and loop portions being fixed at one of the upper portions of the vamp, and the hook and loop portions engaging to hold the tongue to the one upper portion of the vamp. The tongue includes a fixed lower end and a free upper end. The hook and loop fastener is located near the free upper end of the tongue. In one embodiment, the hook or loop portion is fixed adjacent to eyelets provided along the upper portion of the vamp. More particularly, in one embodiment, one of the hook and loop portions is fixed near the free upper end of the tongue and the other of the hook and loop portions is fixed to the overlying upper portion of the vamp about one of the eyelets. In another embodiment, the loop portion is fixed to the tongue while the hook portion is fixed to the overlying upper portion of the vamp for minimizing abrading action on a lace interconnecting the eyelets of the oppositely disposed upper portions of the vamp.

5 Claims, 4 Drawing Figures

SHOE TONGUE HOLDER ASSEMBLY

This application is a continuation of application Ser. No. 376,425 filed May 10, 1982, now U.S. Pat. No. 4,442,613.

BACKGROUND OF THE INVENTION

This invention relates generally to improvements in a shoe tongue holder assembly, and more particularly to an improved assembly for holding the shoe tongue in place while fitting the shoe on the foot of the wearer and during the wearing of such shoe.

In the heretofore conventional shoe having a tongue fixed at its lower end and having a free upper end, it was difficult to maintain the tongue securely in place over and on the appropriate center front portion of the foot and in the desired position under the overlying vamp while placing the shoe on the foot because of the tendency of the free upper end of the tongue to move sideways and/or downwardly into the shoe upon engagement with the foot, and also while wearing the shoe because of the tendency of the tongue to creep sideways and/or downwardly into the shoe as a result of the relative flexing action of the tongue and the frictional engagement of the foot with the tongue.

SUMMARY OF THE INVENTION

The present shoe tongue holder assembly maintains the tongue securely in a position relative to the center front portion of the foot and relative to the overlying vamp of the shoe during placement of the shoe on the foot of the wearer, and while the shoe is worn without any creepage either sideways or downwardly into the shoe.

In the present shoe tongue holder assembly, the shoe includes a vamp having oppositely disposed upper portions overlying a tongue, and a securing means interconnecting the upper vamp portions for selectively adjusting the fit of the upper vamp portions over and on the tongue and for selectively adjusting the fit of the vamp for the comfort of the wearer. A hook and loop fastener operatively interconnects the tongue and vamp for holding the tongue in place.

In one aspect of the shoe tongue holder assembly, the hook and loop fastener includes a hook portion and a loop portion made of Velcro, one of the hook and loop portions being fixed to the tongue and the other of the hook and loop portions being fixed to one of the uppers. The hook and loop portions engage to hold the tongue to the one upper portion.

In another aspect of the shoe tongue holder assembly, the tongue includes opposed side margins underlying the upper portions of the vamp. One portion of the hook and loop fastener is fixed to one of the side margins of the tongue, and the other portion of the hook and loop fastener is fixed to the upper vamp portion overlying the said one side margin of the tongue. These hook and loop portions are selectively alignable and engageable. Further, the upper vamp portions include laterally spaced inner margins. More particularly, that hook or loop portion of the hook and loop fastener fixed to the upper vamp portion is located at the inner margin of the upper vamp portion overlying the said one side margin of the tongue to which the other portion of the hook and loop fastener is fixed.

In another aspect of the shoe tongue holder assembly, the tongue includes a fixed lower end and a free upper end. The hook and loop fastener is located near the free upper end of the tongue.

In another aspect of the shoe tongue holder assembly, the securing means includes a plurality of spaced eyelets along each of the upper vamp portions. One of the hook and loop portions is fixed to one side margin of the tongue, and the other of the hook and loop portions is fixed to the inner margin of the overlying upper vamp portion adjacent to the eyelets.

Another aspect of the shoe tongue holder assembly provides for the placement of one of the hook and loop portions to the side margin of the tongue near the free upper end of the tongue, and for the placement of the other hook and loop portion at the inner margin of the overlying upper vamp portion about one of the eyelets.

In another aspect of the shoe tongue holder assembly in which the securing means includes a lace interconnecting the eyelets of the oppositely disposed upper vamp portions, the loop portion of the hook and loop fastener is fixed to the side margin of the tongue, and the hook portion is fixed to the inner margin of the overlying upper vamp portion for minimizing abrading action on the lace.

DESCRIPTION OF THE PREFERRED EMBODIMENT

Figure 1:
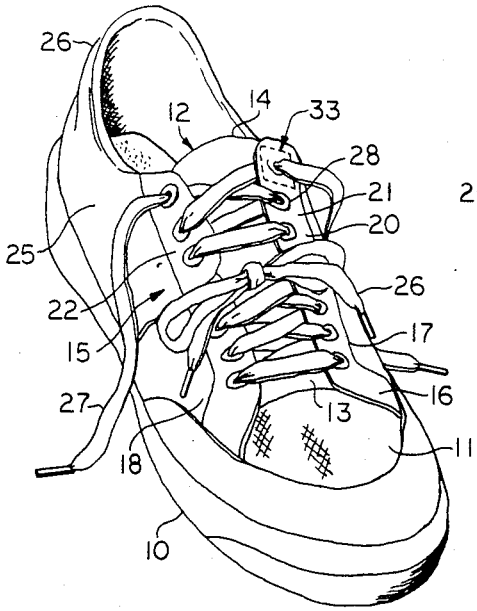
FIG. 1 is a perspective view of one shoe construction utilizing the shoe tongue holder assembly.

Referring first to the shoe construction of FIG. 1, it will be understood that the shoe includes a sole 10, and a front toe portion 11 fixed to the front portion of the sole 10. A tongue, generally indicated at 12, includes a lower end 13 fixed to the toe portion 11 and a free upper end 14.

In this shoe construction, the vamp referred to by 15 includes a lower vamp section 16 adjacent the front toe portion 11 having oppositely disposed upper vamp portions 17 and 18 overlying the lower part of the tongue 12. Further, the vamp 15 includes an upper vamp section 20 having oppositely disposed upper vamp portions 21 and 22 partially overlapping the upper vamp portions 17 and 18 respectively of the lower vamp section 16, and overlying the upper part of the tongue 12.

Figure 3:
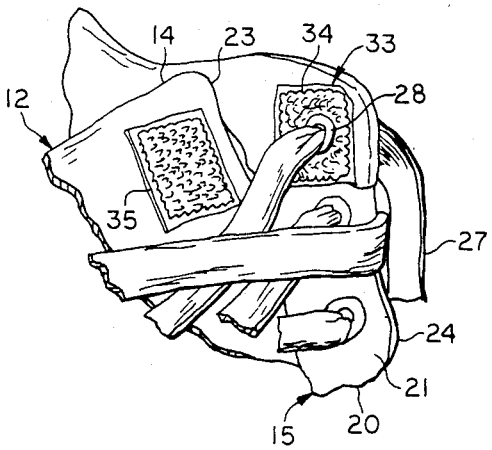
FIG. 3 is an enlarged, fragmentary view showing the placement of the hook and loop fastener on the tongue and vamp prior to engagement of the hook and loop portion.

As is best seen in FIG. 3, the tongue 12 includes opposed side margins 23 that underlie the upper vamp portions 21–22 of the upper vamp section 20, and underlie the upper vamp portions 17–18 of the lower vamp section 16. Further, the upper vamp portions 21 and 22 of the upper vamp section 20 and the upper vamp portions 17 and 18 of the lower vamp section 16 include laterally spaced inner margins 24 that overlie the side margins 23 of the tongue 12. To complete the shoe construction, the shoe includes the conventional side quarters 25 and heel 26 at the rear portion of the sole 10.

A securing means interconnects the upper vamp portions 21 and 22 of the upper vamp section 20, and interconnects the upper vamp portions 17 and 18 of the lower vamp section 16 for selectively adjusting the fit of the upper vamp portions 21–22 and 17–18 over and on the tongue 12 and for selectively adjusting the vamp 15 for the comfort of the wearer.

More particularly, the securing means includes a plurality of spaced eyelets along each of the upper vamp portions 21–22 and 17–18 of the upper vamp section 20 and lower vamp section 16 respectively. A first lace 26 is passed through the eyelets 28 on the upper vamp portions 17–18 of the lower vamp section 16 to operatively interconnect the upper vamp portions 17–18. This lace 26 can be adjusted and tied as shown in FIG. 1 to adjust the lower vamp section 16 to the toe portion of the wearer's foot. A second lace 27 is passed through the eyelets 28 of the upper vamp portions 21–22 of the upper vamp section 20, and is tied to adjust the fit of the upper vamp section 20 to the front portion of the wearer's foot. Each vamp section 16 and 20 can be independently and selectively adjusted for the comfort of the wearer by adjusting and tieing the respective laces 26 and 27.

Figure 2:
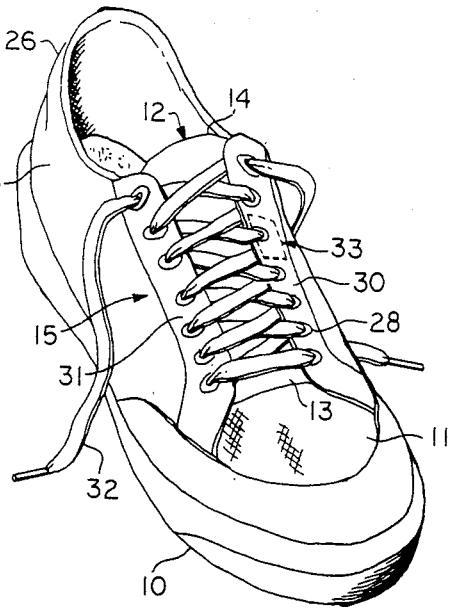
FIG. 2 is a perspective view of another embodiment of a shoe construction utilizing the shoe tongue holder assembly.
Figure 4:
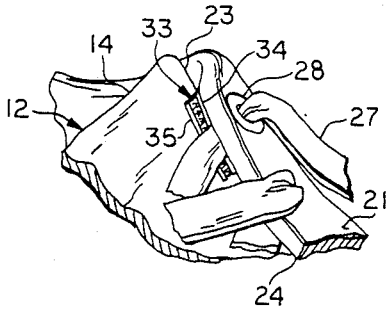
FIG. 4 is a fragmentary view similar to FIG. 3, but illustrating the closure of the tongue and vamp upon operative engagement of the hook and loop fastener.

The shoe construction shown in FIG. 2 is similar to the shoe construction shown in FIG. 1, and accordingly, identical reference numerals will be utilized to indicate similar or identical parts. The primary difference between the shoe constructions of FIGS. 1 and 2 resides in the fact that the vamp 15 in in FIG. 2 is a single continuous vamp section having oppositely disposed upper vamp portions 30 and 31. These upper vamp portions 30–31 of the vamp 15 also include laterally spaced inner margins 24 that can be said to be illustrated also in FIGS. 3 and 4, the inner margins 24 overlying opposed side margins 23 of tongue 12 that can said to be shown also in FIGS. 3 and 4. The securing means also includes a plurality of spaced eyelets 28 along each of the upper vamp portions 30–31 of the vamp 15 that can be said to be shown also in FIGS. 3 and 4. A single lace 32 is passed through the eyelets 28 for operatively interconnecting the oppositely disposed upper vamp portions 30–31 of the vamp 15. The lace 32 can be adjusted and tied to adjust the fit of the vamp 15 over and on the tongue 12 and to adjust the fit of the vamp 15 on the foot for the comfort of the wearer.

A hook and loop fastener, generally indicated by 33, operatively interconnects the tongue 12 and vamp 15 for holding the tongue 12 in place. The hook and loop fastener 33, made of Velcro, includes a hook portion 34 fixed to the underside of the upper vamp portion 21 of the upper vamp 20 in the embodiment of FIG. 1, and fixed to the underside of the upper vamp portion 30 of the single vamp 15 in the embodiment of FIG. 2. The fastener 33 also includes a loop portion 35 fixed to the tongue 12 in alignment with the hooked portion 34 so that the hook and loop portions 34–35 interengage to hold the tongue 12 to the upper vamp portion 21 (FIG. 1) and to the upper vamp portion 30 (FIG. 2).

The connection of the hook portion 34 and loop portion 35 of the fastener 33 can be reversed if desired so that the loop portion 35 is attached to the underside of the upper vamp portion 21 (FIG. 1) and to the underside of the upper vamp portion 30 (FIG. 2), while the hook portion 34 is fixed to the tongue 12. However, for reasons which will be later discussed, it is preferred that the hook portion 34 be fixed to the upper vamp portion 21 (FIG. 1) and to the upper vamp portion 30 (FIG. 2), and that the loop portion 35 be fixed to the tongue 12.

More particularly, the loop portion 35 of the fastener 33 is fixed to the side margin 23 of the tongue 12, and the hook portion 34 is fixed to the upper vamp portion 21 of vamp 20 (FIG. 1) and to the upper vamp portion 30 of the single vamp 15 (FIG. 2), overlying the side margin 23 of the tongue 12. The hook portion 34 is preferably fixed to the inner margin 24 of the upper vamp portion 30 of the single vamp 15 (FIG. 2). In the embodiment of FIG. 1, the hook and loop fastener 33 is located near the free upper end 14 of the tongue 12. In the embodiment of FIG. 2, the hook and loop fastener 33 is slightly spaced from the end margin of the free upper end 14 of the tongue 12, but is located at such tongue end 14.

Further, it will be understood that the hook and loop fastener 33 has the loop portion 35 fixed to the side margin 23 of the tongue 12, while the hook portion 34 is fixed to the inner margin 24 of the overlying upper vamp portion 21 of vamp 20 (FIG. 1), and is fixed to the overlying upper vamp portion 30 of the single vamp 15 (FIG. 2) adjacent to the eyelets 28 along the respective upper vamp portions 21 and 30. In this position, the hook portion 34 and loop portion 35 are selectively alignable and engageable to hold the side margin 23 of the tongue 12 to the inner margin 24 of the respective overlying upper vamp portions 21 and 30. Particularly, the hook portion 34 is fixed to the inner margin 24 of the respective upper vamp portions 21 and 30 about one of the eyelets 28.

When a lace operatively interconnects the eyelets 28 of the oppositely disposed upper vamp portions 21–22 or 30–31, it will be understood that such lace will engage that portion of the hook and loop fastener 33 fixed to the side margin 23 of tongue 12 when the hook and loop portions 34–35 interengage. Because of the tendency of the tongue 12 to move and shift, it is possible if the hook portion 34 of the fastener 33 were fixed to the tongue 12, that such hook portion 34 would abrade the lace. For this reason, it is preferred that the loop portion 35 be fixed to the tongue 12 and that the hook portion 34 be fixed to the underside of the overlying upper vamp portion 21 of vamp 20 (FIG. 1) and to the upper vamp portion 30 of the single vamp 15 (FIG. 2) in order to minimize any abrading action on the lace.

It is thought that the usage of the hook and loop fastener 33 has become apparent from the foregoing detailed description, but for completeness of disclosure, such usage and functional results will be briefly described.

Referring first to the shoe embodiment of FIG. 1, it will be understood that the laces 26 and 27 are loosened so that the foot of the wearer can be inserted into the shoe. Before insertion of the foot, the hook and loop portions 34–35 of the fastener 33 can be engaged to lock the tongue 12 securely in place to the upper vamp portion 21 of vamp 20 so as to hold tongue 12 securely in place while the foot is inserted. Then, the lower lace 26 can be tightened to adjust the lower vamp 16 to the toe portion of the foot. Then, the upper lace 27 can be tightened to adjust the upper vamp 20 to the upper front portion of the foot, independently of the adjustment of the lower vamp 16. During this adjustment of the laces 26 and 27, the tongue 12 is held securely in place by the hook and loop fasteners 33. Moreover, it will be understood that the tongue 12 is held securely in place without any shifting either laterally or downwardly while the shoe is worn, as might otherwise be caused by the flexing action of the foot within the shoe.

The usage of the hook and loop fastener 33 in the shoe embodiment of FIG. 2 is essentially the same as that described above with respect to the shoe embodiment of FIG. 1. The only difference in the shoe embodiment of FIG. 2 is that a single lace 32 is utilized to adjust the fit of the vamp 15 to the foot of the wearer. The hook and loop fastener 33 has the same functional result during the placement of the foot into the shoe and during the wearing of the shoe so as to hold the tongue 12 securely in place without any lateral shifting or movement downwardly.

I claim as my invention:

1. A shoe comprising:

(a) a tongue, (b) a vamp including oppositely disposed portions overlying the tongue, (c) securing means interconnecting the vamp portions for selectively adjusting the fit of said portions over and on the tongue for the comfort of the wearer, (d) fastener means operatively interconnecting the tongue and vamp for holding the tongue in place during fitting and wearing of the shoe, (e) the tongue including opposed side margins underlying the portions of the vamp, one of said margins being selectively operatively interconnected to its overlying vamp portion by the fastener means, and the other of said margins being free of operative interconnection to its overlying vamp portion.

2. A shoe as defined in claim 1, in which:

(f) the tongue includes a fixed lower end and a free upper end, and (g) the fastener means is located near the free upper end of the tongue.

3. A shoe comprising:

(a) a tongue including opposed side margin portions, (b) a vamp means including oppositely disposed portions overlying the tongue side margin portions, (c) securing means extending between and interconnecting the vamp portions for selectively adjusting the fit of said portions over and on the tongue for the comfort of the wearer, (d) fastener means operatively interconnecting the tongue and one of said latter two means, at least one of said tongue side portions being free of operative interconnection to its overlying vamp portion.

4. A shoe as defined in claim 3, in which:

(e) the fastener means includes a hook and loop fastener and operatively interconnects one of said tongue side margins portions and its overlying vamp portion, the other of said vamp portions being free of operative interconnection to its overlying vamp portion.

5. A shoe as defined in claim 3, in which:

(e) the fastener means includes a hook and loop fastener, (f) the tongue includes a fixed lower end and a free upper end, and (g) the hook and loop fastener is located near the free upper end of the tongue.

* * * * *